United States Patent [19]

Bissell

[11] 4,249,385

[45] Feb. 10, 1981

[54] TWO-PHASE THERMAL ENERGY CONVERSION SYSTEM

[76] Inventor: Lawrence E. Bissell, 1242 26th St., Apt. B, Santa Monica, Calif. 90404

[21] Appl. No.: 899,791

[22] Filed: Apr. 25, 1978

Related U.S. Application Data

[63] Continuation-in-part of Ser. No. 615,931, Sep. 23, 1975, Pat. No. 4,085,591.

[51] Int. Cl.[3] ..... F01K 21/04

[52] U.S. Cl. ..... 60/674; 60/660; 60/649

[58] Field of Search ..... 60/660, 664, 665, 667, 60/674, 673, 649

[56] References Cited

U.S. PATENT DOCUMENTS

| | | | |
|---|---|---|---|
| 456,595 | 7/1891 | Popp | 60/649 |
| 583,240 | 5/1897 | Thomine | 60/674 |
| 770,468 | 9/1904 | Lake | 60/674 |
| 3,861,151 | 1/1975 | Hosokawa | 60/649 X |
| 3,871,180 | 3/1975 | Swanson | 60/674 X |
| 4,106,294 | 8/1978 | Czaja | 60/674 X |

*Primary Examiner*—Allen M. Ostrager
*Attorney, Agent, or Firm*—Henry M. Bissell

[57] ABSTRACT

A two-phase thermal energy conversion system employs an evaporable liquid such as water, and a gas which is not liquefiable within the operating temperature and pressure ranges, such as air. The water and air are mixed and one of the two or both are heated so that the water evaporates and is absorbed by the air to result in a pressure increase. The increase of pressure or volume can be converted into mechanical energy by a prime mover such as a turbine or reciprocating piston engine. The heat of condensation is utilized and converted into mechanical power while the temperature and pressure are reduced. The liquid, such as water, may be below its boiling point. If the water consists of salt water, fresh water is derived as a condensation product from the prime mover.

33 Claims, 5 Drawing Figures

TWO-PHASE THERMAL ENERGY CONVERSION SYSTEM

CROSS-REFERENCE TO RELATED APPLICATION

This application is a continuation-in-part of my copending application Ser. No. 615,931, filed on Sept. 23, 1975, now U.S. Pat. No. 4,085,591.

BACKGROUND OF THE INVENTION

1. Field of the Invention.

This invention relates generally to heat engines and more particularly relates to a two-phase thermal energy conversion system.

2. Description of the Prior Art.

Many types of heat engines are known to the art. The most efficient of these at the present time is the steam turbine. However, even a steam turbine converts less than half of the heat of the steam into mechanical power. The remainder of the heat remains in the steam which without condensation is at or near atmospheric pressure as it leaves the turbine. Hence, this steam has no additional realizable expansion force. It is usually condensed for reuse and the heat of condensation is generally lost to the system. Many disadvantages are encountered in the conventional methods employed for the disposal or use of this heat.

The efficiency of internal combustion engines is also relatively low. Here again the exhaust gas contains most of the original heat but its pressure is near atmospheric pressure and hence it lacks further mechanically usable energy.

In order to convert salt water into fresh water, distillation systems are conventionally used. However these systems also lose the heat of condensation. This is similar to the heat loss suffered by a steam turbine and has similar disadvantages.

SUMMARY OF THE INVENTION

In accordance with the two-phase thermal energy conversion system of the invention, the heat of condensation can be converted to mechanical power with increased efficiency. It is of potential use in the conversion of solar energy. This is due to the fact that it will convert heat to energy contained in water below the boiling point of water at atmospheric pressure. Such hot water may be stored conveniently and economically for use at a later time, for example when no sunlight is available. Also, the system of the present invention may utilize sea water or other salt water. In this case, fresh water may be obtained as the output of a prime mover of the system. This is in addition to the mechanical power obtainable from the heat of the water.

It is well known that water vapor forms and mixes with air when air and water are in intimate contact at temperatures which are, for example, below the boiling point of water. The amount of water vapor absorbed by the air until it is completely saturated depends on the temperature of the mixture when the pressure remains constant, such as at atmospheric pressure. At higher temperatures the proportion of water vapor absorbed by the air increases. This increase of the water vapor rises rapidly as the temperature nears the boiling point of water. In that case the volume of water vapor absorbed by the air is many times that of the volume of air. Hence an increase of the volume under constant pressure is achieved at temperatures at or below the boiling point of water.

Under those conditions, either the volume will increase or, if the volume is confined, the pressure will increase. Hence when air and water are mixed at elevated temperatures until the air is saturated, the increase equals the vapor pressure of the water at the prevailing temperature of the mixture.

These principles are utilized in accordance with the present invention by mixing a first fluid consisting of a liquid evaporable within a range of predetermined or operating temperatures and pressures and a second fluid consisting of a gas which cannot be liquefied within this predetermined temperature and pressure range. One or both of the two fluids is heated. The liquid may consist of water and the gas may consist of air. The water and air are mixed, preferably to equilibrium at a given temperature, and the equilibrium mixture is fed to a prime mover for extracting energy from the mixture. The mixture is in equilibrium when the air is saturated by water vapor at the temperature of the mixture. The corresponding pressure is the equilibrium pressure for that temperature.

The prime mover may, for example, be coupled to an electric generator to generate electric energy.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

DESCRIPTION OF THE PREFERRED EMBODIMENTS

Figure 1:
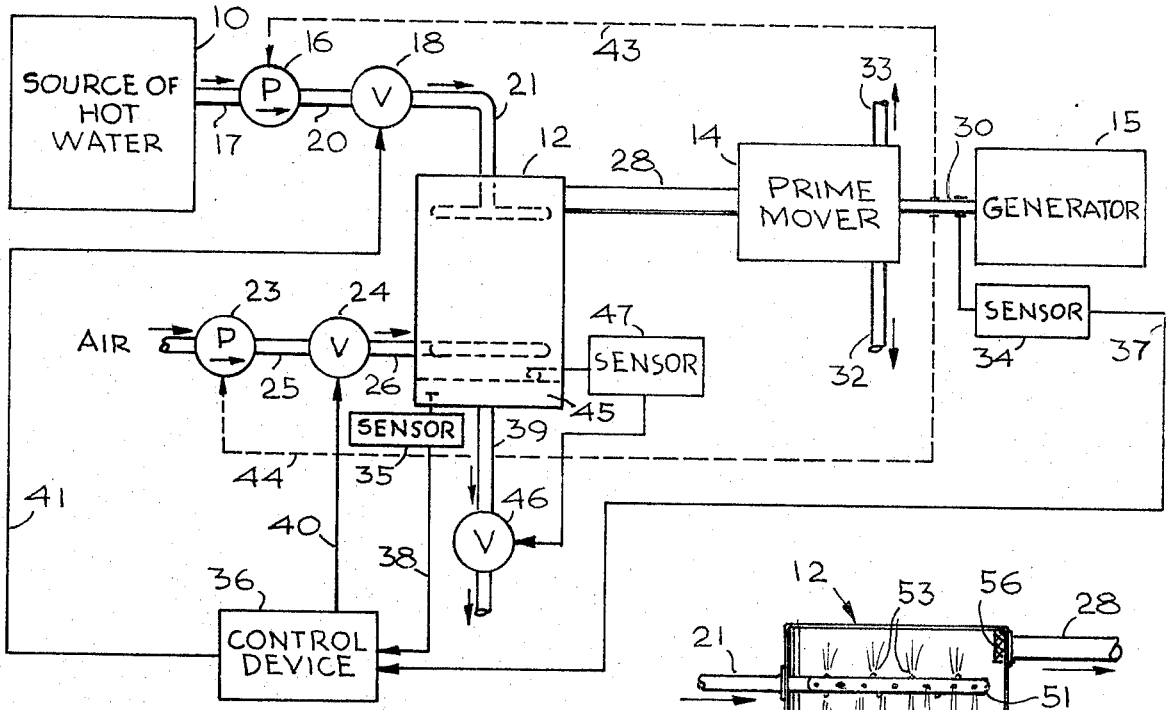
FIG. 1 is a schematic representation of a two-phase thermal energy conversion system embodying the present invention and utilizing a source of hot water.

Referring now to the drawings and particularly to FIG. 1, there is illustrated a first embodiment of the two-phase energy conversion system of the invention. The system of FIG. 1 includes a source of hot water 10, an evaporator 12, a prime mover 14 and a device for utilizing the energy of the prime mover such as a generator 15.

The source of hot water 10 is connected to a pump 16 through a conduit 17. Following the pump 16 is a controllable valve 18 connected to the pump by a conduit 20. The output of the valve 18 is connected to the evaporator or mixing chamber 12 by a conduit 21. The evaporator 12 may have the form shown in FIG. 2 which is identical to the evaporator disclosed in my parent application hereinabove referred to.

The ambient air is compressed by another pump 23 connected to a controllable valve 24 by a conduit 25. The air from the controllable valve 24 is fed to the evaporator 12 by a conduit 26.

In the evaporator 12 the hot water is mixed with the air in intimate contact. As a result, the air will absorb water vapor and the mixture of air and vapor is fed by a conduit 28 into the prime mover 14. The prime mover 14 is connected to the generator 15 by a mechanical shaft 30.

The water of the source 10 may be hot water obtained from a thermal source heated by solar energy. Alternatively, it may be heated by the low temperature process waste heat of some low temperature process such as the exhaust steam of a steam turbine. The temperature of the hot water may be below the boiling point of water but also may be at or near the boiling point of water, that is, at or near 212° F. at sea level pressure.

In accordance with the two-phase thermal conversion system of the present invention, the vapor pressure of the liquid such as water is utilized which need not necessarily be the steam pressure above the boiling point of the liquid. The liquid could be any liquid which may be evaporated at a predetermined temperature and pressure range which is in the operating temperature and pressure. Similarly, instead of air, any gas may be used which does not liquefy at the operating temperature and pressure range. When a liquid such as water is combined with a gas and when heat is added to the mixture the vapor pressure of the liquid is added to the pressure of the gas. This is in accordance with Dalton's law of partial pressures that the pressure of a mixture of gases such as a gas and a vapor is the sum of the partial pressures of the individual gases when they exist at the total volume and temperature of the mixture. Hence it will be realized that the mixture of water vapor and air will have either an enlarged volume or with a fixed volume, an increased pressure over that of either constituent alone.

It is this increased pressure which is utilized in accordance with the present invention to extract mechanical energy by the prime mover 14. In this process there is an optimum ratio of water vapor to air which is that amount of water vapor sufficient to saturate the air at the operating temperature and pressure.

As an example, if boiling water at atmospheric pressure is mixed with air at the same temperature and pressure, and at constant volume, the pressure is doubled. The air absorbs that amount of water vapor which causes the air to be saturated, thus developing a pressure of twice atmospheric. At temperatures below the boiling point of water, the equilibrium pressure at saturation will be less.

The following Table I may be used to calculate equilibrium pressures and other operating characteristics of systems of the present invention.

TABLE I

| 1 | 2 | 3 | 4 | 5 | 6 | 7 | 8 |
|---|---|---|---|---|---|---|---|
| 212 | ·26.799 | 100 | 1150 | 1150 | 81 | 1231 | 0 |
| 200 | 33.639 | 79.7 | 1146 | 913 | 76 | 989 | 19.6 |
| 190 | 40.957 | 65.4 | 1142 | 747 | 72 | 819 | 33.5 |
| 180 | 50.22 | 53.4 | 1138 | 608 | 68 | 676 | 45.0 |
| 170 | 62.06 | 43.2 | 1134 | 490 | 65 | 555 | 54.9 |
| 160 | 77.29 | 34.7 | 1130 | 392 | 61 | 453 | 63.2 |
| 150 | 97.07 | 27.6 | 1126 | 311 | 57 | 368 | 70.1 |
| 140 | 123.0 | 21.8 | 1122 | 245 | 53 | 298 | 75.8 |
| 130 | 157.33 | 17.0 | 1118 | 190 | 49 | 239 | 80.5 |

TABLE I-continued

| 1 | 2 | 3 | 4 | 5 | 6 | 7 | 8 |
|---|---|---|---|---|---|---|---|
| 120 | 203.26 | 13.2 | 1114 | 147 | 46 | 193 | 84.3 |

Column 1 shows the temperature in degrees F. of the mixture of water and air within the prime mover 14. Column 2 gives the total volume in cubic feet of one pound of vapor at the temperature shown in Column 1. This may readily be obtained from a so-called steam table. Such a table has been published for example by Combustion Engineering-Superheater, Inc., 3rd Edition, 1940. Similar tables are obtainable elsewhere, as for example from the book "Thermo-dynamic Properties of Steam" by Keenan et al, published by John Wiley, New York, 1937.

Column 3 indicates the percentage of water remaining in the mixture as vapor. This is calculated on the assumption that the original mixture contained one pound of vapor but at lower temperatures and at reduced pressures this volume will contain progressively less vapor. This is readily obtainable from the steam table. The percentages are obtained by dividing the original volume by the instant volume and multiplying by 100. This value is only approximate in that the condensed vapor would also occupy some volume.

Column 4 is the enthalpy of the vapor in btu/lb. The enthalpy is simply the sum of the total internal energy in btu (British thermal units) plus a product of the absolute pressure and the volume. This set of figures is directly obtainable from a steam table. It represents the amount of energy per pound at the particular condition.

Column 5 shows the energy remaining in the vapor in btu units. This corresponds to the percentage of Column 3 times the energy per pound in Column 4.

Column 6 shows the energy in the air in units of btu. This is obtainable from the handbook of the American Society of Heating and Air Conditioning Engineers (1958 Guide). It should be noted that the value for 212° F. has been extrapolated.

Column 7 shows the total energy, which is the sum of columns 5 and 6. Finally Column 8 represents the efficiency in percent. This is the original energy at 212° F. in Column 7 minus the instant value in Column 7 divided by the original energy times 100. In other words, this is the efficiency that would result if the mixture were to be exhausted from the engine at that temperature at constant volume. This of course shows that this efficiency increases as the exhaust temperature decreases.

It is desirable to control the rates of introduction of air and water to the mixing chamber 12 of FIG. 1 in accordance with the operating conditions of the prime mover 14. In FIG. 1 the condensed water may leave the prime mover 14 through conduit 32 while the air and any remaining water vapor leaves through conduit 33. Where the prime mover 14 exhausts at atmospheric pressure, the conduits 32 and 33 may be open ended. However where the prime mover 14 is operated as part of a closed system, the conduits 32 and 33 may be connected respectively to the air inlet to the pump 23 and to the hot water source 10.

A first sensor 34 is shown mounted on the prime mover drive shaft 30 to monitor the load demand upon the prime mover 14. A second sensor 35 is associated with the evaporator 12 for monitoring the temperature of the discharge water 45 leaving the evaporator. These sensors 34 and 35 jointly feed into a control device 36 as shown by lines 37 and 38. The control device 36 in turn controls the controllable valves 24 and 18 as shown by lines 40 and 41 so that the rate of air flow is proportional to the prime mover load demand while the rate of hot water flow is varied inversely with the discharge water temperature. When controlled in this fashion, the mixture in the conduit 28 is saturated and can be substantially at the temperature of the hot water entering the evaporator 12.

It should be noted that the prime mover 14 may for example be a vapor turbine. For maximum efficiency in the cycle of operation of the present invention, the turbine should be of substantially constant volume, which requires that the turbine be of substantially constant axial cross-section from inlet to outlet.

Alternatively, the prime mover 14 may comprise a reciprocating engine. In this case, for example, hot water may be sprayed into a cylinder that contains dry air, thus combining the mixing chamber 12 within the prime mover 14. The hot water vaporizes and humidifies the air. In this case, the pressure inside the cylinder is increased by an amount which is only slightly less than the vapor pressure of the injected water. Thereafter this humid mixture expands, doing work on the piston under conditions of increasing volume and decreasing pressure.

It is also feasible to drive the pumps 16 and 23 through the prime mover 14. This is schematically indicated by broken lines 43 and 44.

Additionally, the water which accumulates in the evaporator 12 as shown at 45 may be vented outside through a valve 46 which is controlled by a sensor 47 in accordance with the level of the water 45 in the evaporator 12.

It should be noted that the source of hot water may be sea water or other salt water. In this case, the water recovered from conduit 32 from the prime mover will be fresh water which is obtained as a byproduct of the energy conversion system of the invention.

Another form of piston engine which could be used compresses air to the vapor pressure of water above the atmospheric boiling point of the water at the top of the stroke. In this case either hot water or steam may be mixed with the air on the down stroke. The addition of the water or steam is effected at a rate to maintain the maximum pressure over a portion of the stroke. This action is similar to that of a diesel cycle.

Figure 2:
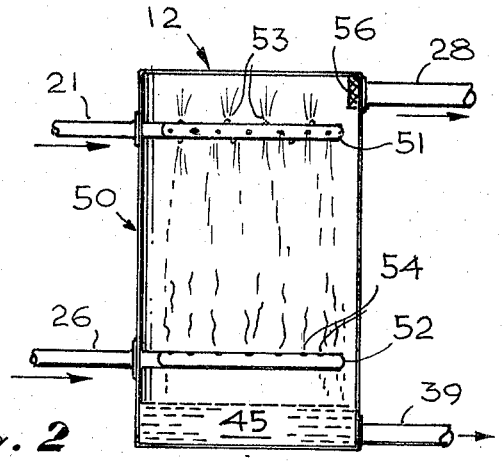
FIG. 2 is a cross-sectional view of an evaporator which may be used with the system of FIG. 1.

Referring now to FIG. 2, there is shown in greater detail one preferred arrangement of the evaporator 12. It comprises a comparatively large tank 50 which may be of cylindrical form. In its interior region there is disposed a water spray unit 51 and an air inlet unit 52. A plurality of water spray nozzles or orifices 53 are formed along the water spray unit 51 which may simply be a pipe. It may be an elongated tube or a ring disposed about the top of the evaporator 12. The nozzles 53 may be directed in such a direction to spray the water into the evaporator 12 in all directions or to spray generally downwardly only. A plurality of air discharge orifices 54 are formed in the air inlet unit 52. They are preferably directed generally upwardly toward the liquid spray unit 51. The air inlet unit is disposed near the bottom of the tank 50 but above the water level 45 in the bottom of the tank. A liquid drain line 39 is connected to the controllable valve 40 of FIG. 1. The air-vapor outlet line 28 is connected to a top region of the tank 50 above the fluid spray unit 51. A filter 56 may be disposed at the outlet end of the hot air conduit 28 to remove water droplets.

The evaporator of FIG. 2 functions as described in the parent application referred to above.

Figure 3:
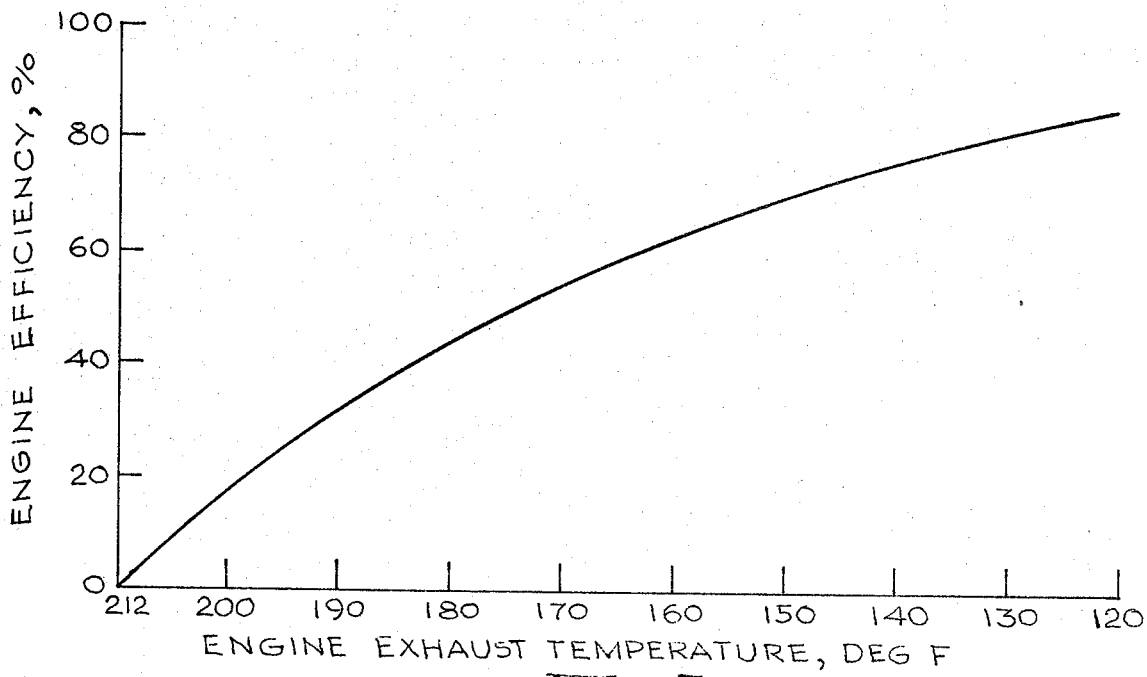
FIG. 3 is a chart relating the engine exhaust temperature in degrees F. to the engine efficiency in percent in a constant-volume engine.

FIG. 3, to which reference is now made, indicates the theoretical engine efficiency at constant volume of prime mover 14 as a function of the engine exhaust temperature in degrees F. The chart of FIG. 3 was obtained from the efficiency in percent as shown in Column 8 of Table I.

Figure 4:
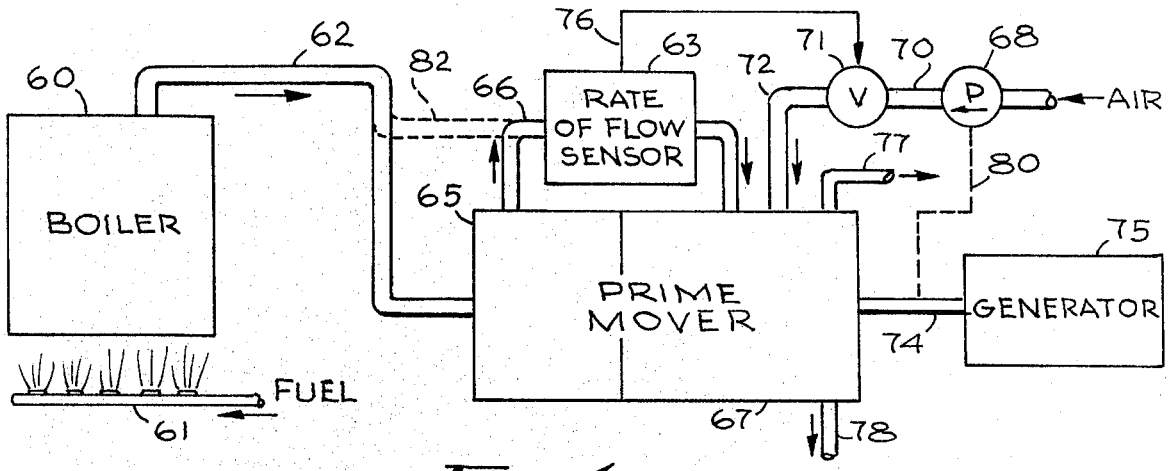
FIG. 4 is a schematic representation of a second embodiment of the energy conversion system of the invention utilizing a boiler, and two coupled prime movers which may each consist of a turbine.

A second embodiment of the thermal energy conversion system of the invention is illustrated in FIG. 4. This system comprises a conventional boiler 60 which may be heated by fuel entering the fuel line 61. The water is heated until steam is obtained which is fed by conduit 62 into a first portion 65 of a prime mover. The prime mover portion 65 may be a steam turbine. The steam turbine 65 extracts heat from the steam and the steam pressure drops to a low value as it exits the steam turbine 65 through conduit 66 into a second portion 67 of the prime mover via a rate of flow sensor 63. The prime mover portion 67 may also be a turbine such as a vapor turbine of constant volume. The rate of flow sensor 63 may for example include a Venturi tube or the like.

The steam at a reduced pressure and temperature is now mixed with air in the portion 67. To this end, ambient air may be pumped by a pump 68 and fed through a conduit 70 to a controllable valve 71 which in turn supplies the compressed air by conduit 72 to the turbine 67.

As before, the prime mover 67 may drive a drive shaft 74, and an electric generator 75 or the like.

The rate of flow sensor 63 output is used to control the controllable valve 71 as indicated by the line 76. The control is such that the volume of steam and air supplied to the prime mover 67 are in such proportions to effect substantially optimum condensation of the water vapor in the turbine 67.

The air and any remaining water vapor are discharged through conduit 77 while the condensate or water is discharged through line 78.

As shown by the broken line 80, the drive shaft 74 may be coupled to the pump 68 for driving the pump.

It will be understood that the water discharged at conduit 78 may be fed back into the boiler 60 by a conventional feedwater pump. A closed system may be employed in which the air from conduit 77 is fed back into the pump 68, in which case the pressure of the system is not tied to atmospheric pressure.

Where appropriate, as for example where the boiler 60 is replaced with a source of low pressure steam, the prime mover portion 65 may be dispensed with and the low pressure steam may be fed directly to the prime mover 67 via the rate of flow sensor 63. This is represented in FIG. 4 by the broken lines 82 shown connecting directly between the pipes 62 and 66, bypassing the portion 65.

Figure 5:
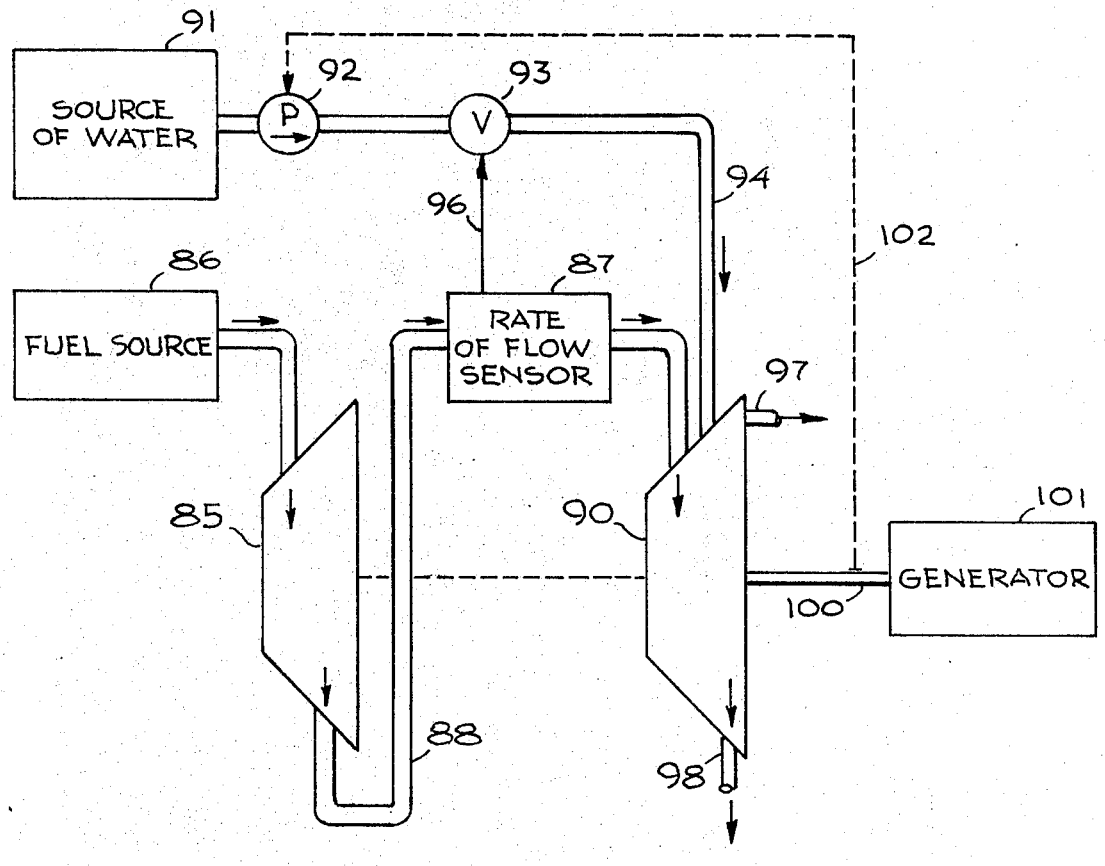
FIG. 5 is a schematic representation of a third embodiment of the energy conversion system of the present invention featuring a gas turbine, the exhaust of which is mixed with water and feeds a vapor turbine.

Another embodiment of the two-phase thermal energy conversion system of the invention is illustrated in FIG. 5 to which reference is now made. Here a gas turbine 85 is fed from a fuel source 86.

The products of combustion of the gas turbine 85 are fed through a conduit 88 into another turbine 90 via a rate of flow sensor 87. The turbine 90 may be a vapor turbine. In this case, of course, it is a gas which is hot rather than the liquid. The liquid may be water obtained from a source of water 91 which is pumped by a pump 92 past the controllable valve 93 and through a conduit 94 into the vapor turbine 90. By means of the rate of flow sensor 87 as shown by lead 96, the valve 93 is controlled. Thus the volume of the hot gas from the exhaust of gas turbine 85 is proportional to the volume of water obtained through valve 93 to obtain substantially optimum condensation of the water vapor in vapor turbine 90. The exhaust gases and any remaining water vapor are discharged through line 97 while the condensate water itself is discharged through line 98. The vapor turbine 90 may have an output shaft 100 to drive a generator 101 or some other useful work producing engine. The output shaft 100 may be connected as shown by dotted line 102 to the pump 92 for driving it. The turbines 85 and 90 are shown coupled together mechanically but it will be understood that such a mechanical coupling maybe dispensed with and the turbines may have independent power outputs if desired.

It will be understood that the water obtained from conduit 98 may be recycled by reinserting it into the water source 91. As a further alternative the block 85 may represent simply a burner for fuel from the source 86 or may be any source of hot gas. The sensor 87 monitors the hot gas and controls the rate of water flow accordingly for mixing in the vapor turbine 90.

There has thus been disclosed a two-phase thermal energy conversion system. The system of the present invention may for example utilize hot water which may be at or near the boiling point and a gas which is not liquefiable at the operating temperature and pressure such as air. The system utilizes the fact that with a constant volume a pressure increase takes place when water is evaporated into dry air. This pressure increase may then be utilized to drive a prime mover such for example as a turbine or a reciprocating piston engine. It is preferable in systems of the invention that the volume of water and the volume of air be controlled to effect substantially optimum condensation of the evaporated liquid in the prime mover. It is also feasible to utilize salt water such as sea water, in which case fresh water is obtainable from the exhaust of the prime mover. Since the system of the present invention operates preferably at relatively low temperatures such as those at or below the boiling point of water, the prime mover may be constructed of relatively inexpensive materials which do not need to withstand high temperatures. It is also able to operate on heat energy derived from waste heat of conventional steam power systems which operate at high temperatures, as well as energy from low grade heat sources such as geothermal, solar, and the like. Because of the operation at relatively low maximum temperatures and pressures, plastic working parts can be used and the mechanical prime movers can be made very cheaply to handle large displacements. The associated pumps and fans or blowers can also be small and economical. Heat exchanges, where employed, can be similar to automotive radiators.

What is claimed is:

1. A two-phase energy conversion system comprising:

(a) a source of a first fluid which is evaporable within a predetermined range of temperatures and pressures;

(b) a source of a second fluid consisting of a gas which is not liquefiable within said range;

(c) means for heating at least one of said fluids;

(d) means for mixing said fluids;

(e) means for supplying the fluids under pressure to the mixing means;

(f) a prime mover coupled to be driven by said mixture;

(g) sensing means for monitoring at least one operating condition of the prime mover; and (h) control means responsive to the sensing means for controlling the ratio of flow rates of the first and second fluids to the mixing means so as to substantially saturate the second fluid with the first fluid over a pressure range up to twice the absolute pressure of the prime mover exhaust at equilibrium temperature.

2. An energy conversion system as defined in claim 1 wherein said first fluid consists of water and said second fluid consists of air.

3. An energy conversion system as defined in claim 2 wherein said prime mover comprises a turbine.

4. An energy conversion system as defined in claim 2 wherein said prime mover comprises a reciprocating piston engine.

5. An energy conversion system as defined in claim 2 wherein said water is heated to a temperature not greater than its boiling point.

6. An energy conversion system as defined in claim 1 wherein the prime mover comprises one having substantially constant volume.

7. An energy conversion system as defined in claim 3 wherein the turbine has substantially constant axial cross-sectional area from inlet to outlet.

8. An energy conversion system as defined in claim 2 wherein the water consists of salt water, whereby the exhaust of said prime mover is fresh water.

9. The system of claim 1 wherein the sensing means are coupled to monitor the load demand on the prime mover and the temperature of discharge water from the mixing means, respectively, and wherein the control means are operative to control the rate of flow of at least one of said fluids to the mixing means in accordance with signals from the sensing means.

10. The system of claim 9 further comprising first and second valves of respectively controlling the rate of flow of the first and second fluids to the mixing means such that the rate of flow of the second fluid is proportional to prime mover load demand while the rate of flow of the first fluid is varied inversely with the temperature of discharge water from the mixing means.

11. The system of claim 1 wherein the mixing means is incorporated with the prime mover.

12. The system of claim 11 wherein the sensing means is connected to monitor the rate of flow of the first fluid to the prime mover for mixing therein, and wherein the control means controls the rate of flow of the second fluid to the prime mover in accordance with signals from the sensing means.

13. The system of claim 11 wherein the sensing means is connected to monitor the rate of flow of the second fluid to the prime mover for mixing therein, and wherein the control means varies the rate of flow of the first fluid to the prime mover in accordance with signals from the sensing means.

14. A two-phase thermal energy conversion system comprising:

(a) a source of hot water;

(b) a first pump connected to said source for pumping the hot water;

(c) a first controllable valve connected to said pump for controlling the rate of flow of water;

(d) an evaporator connected to said controllable valve to receive hot water therefrom;

(e) a second pump for pumping ambient air;
(f) a second controllable valve connected to said second pump for supplying a predetermined rate of air flow to said evaporator, said evaporator having means for mixing the air and water pumping thereto, thereby to evaporate the water and to provide moist air at an increased pressure;
(g) a prime mover connected to said evaporator for receiving the mixture of hot moist air and vapor, thereby to extract energy from the mixture;
(h) first means for sensing the temperature of water discharged from the evaporator;
(i) second means for sensing the load on the prime mover; and
(j) means responsive to said sensing means for controlling said first and second controllable valves to control the rates of water and air supplied for mixing in the evaporator to develop an equilibrium mixture for application to said prime mover.

15. A system as defined in claim 14 wherein an electric generator is coupled to said prime mover.

16. A system as defined in claim 14 wherein said first and second pumps are coupled to be driven by said prime mover.

17. A system as defined in claim 14 wherein an additional sensor is provided to sense the level of water in said evaporator for controlling the outflow of water from said evaporator.

18. A system as defined in claim 14 wherein the rate of flow of air is controlled proportionally to the load on the prime mover and wherein the rate of flow of hot water is controlled inversely to the temperature of the evaporator discharge water.

19. The system of claim 14 wherein the controlling means are operated to develop substantial saturation of the mixture of air and vapor.

20. A two-phase energy conversion system comprising:
(a) a source of a first fluid which is evaporable within a predetermined range of temperatures and pressures;
(b) a source of a second fluid consisting of a gas which is not liquefiable within said range;
(c) means for heating at least one of said fluids;
(d) means for pressurizing the fluids;
(e) means for mixing the vapor of said first fluid with said second fluid;
(f) a prime mover of substantially constant volume coupled to be driven by the resulting mixture; and
(g) means for selectively adjusting the ratio of first fluid vapor mixed with the second fluid in accordance with selected operating conditions of the prime mover to maintain the second fluid substantially saturated with vapor of the first fluid.

21. A two-phase energy conversion system comprising:
(a) a source of a first fluid which is evaporable within a predetermined range of temperatures and pressures;
(b) a source of a second fluid consisting of a gas which is not liquefiable within said range;
(c) means for heating at least one of said fluids;
(d) means for pressurizing the fluids;
(e) means for mixing vapor of said first fluid with said second fluid;
(f) a prime mover coupled to be driven by the resulting mixture, the prime mover being of substantially constant volume so as to preclude significant expansion of the fluid mixture therein; and
(g) means for recycling the exhaust components from the prime mover to supplement the first and second fluids introduced to the mixing means.

22. A process for converting thermal energy to mechanical power in a prime mover comprising the steps of:
(a) a mixing vapor of a first fluid consisting of a liquid which is evaporable over a predetermined range of temperatures and pressures with a second fluid consisting of a gas which is not liquefiable over said range;
(b) controlling the ratio of the first and second fluids to establish a substantially saturated mixture within a pressure range up to twice the exhaust pressure of the prime mover;
(c) pressurizing the fluid mixture and supplying it to the prime mover;
(d) maintaining the volume of the mixture substantially constant through the prime mover;
(e) condensing the first fluid within the prime mover; and
(f) converting the heat of condensation of the first fluid to mechanical power within the prime mover.

23. The process of claim 22 wherein the prime mover is a turbine.

24. The process of claim 22 wherein the first fluid is water and the second fluid is air.

25. The process of claim 24 further comprising the step of directing the condensed water and exhaust gas from the prime mover to be repressurized and mixed for recycling into the prime mover.

26. The process of claim 22 further comprising the step of heating the first fluid prior to mixing with the second fluid.

27. The process of claim 22 further comprising the step of heating the second fluid prior to mixing with the first fluid.

28. The process of claim 26 wherein the first fluid is water and the heating step comprises heating the water to a point not exceeding its boiling point at ambient pressure.

29. A process for converting thermal energy to mechanical power within a prime mover comprising the steps of:
(a) mixing vapor of a first fluid comprising a liquid which is evaporable over a predetermined range of temperatures and pressures with a second fluid comprising a gas which is not liquefiable over said range, the first fluid being heated to provide the preponderance of the heat of vaporization thereof;
(b) pressurizing the fluids;
(c) collecting and removing excess liquid from the mixing step;
(d) supplying the resulting mixture to a prime mover;
(e) sensing at least one of the operating conditions of the prime mover; and
(f) controlling the rate of flow of at least one of the fluids in accordance with signals from the sensing of the prime mover to establish a saturated mixture within the prime mover.

30. The process of claim 29 wherein the sensing step comprises sensing the load demand on the prime mover and the temperature of the excess liquid from the mixing step; and wherein the controlling step comprises controlling the rate of flow of the first fluid to vary inversely with the temperature of the excess liquid from the mixing step and controlling the rate of flow of the second fluid to be proportional to prime mover load demand.

31. The process of claim 29 wherein the mixing step is performed within the prime mover.

32. The process of claim 31 wherein the sensing step comprises sensing the rate of flow of the first fluid; and the controlling step comprises controlling the rate of flow of the second fluid to the prime mover.

33. The process of claim 31 wherein the sensing step comprises sensing the rate of flow of the second fluid; and the controlling step comprises controlling the rate of flow of the first fluid to the prime mover.

* * * * *